United States Patent [19]

Vokey

[11] Patent Number: 4,647,720

[45] Date of Patent: Mar. 3, 1987

[54] CABLE HAVING COMPOSITE SHIELD AND ARMOUR SHEATH DESIGN

[75] Inventor: David E. Vokey, Hickory, N.C.

[73] Assignee: Canada Wire and Cable Limited, Don Mills, Canada

[21] Appl. No.: 676,177

[22] Filed: Feb. 14, 1985

Related U.S. Application Data

[62] Division of Ser. No. 521,372, Aug. 8, 1983, Pat. No. 4,518,034.

[30] Foreign Application Priority Data

Aug. 10, 1982 [CA] Canada ..... 409130

[51] Int. Cl.[4] ..... H01B 7/18

[52] U.S. Cl. ..... 174/107; 174/102 D; 174/106 D; 174/116

[58] Field of Search ..... 174/102 R, 102 D, 106 D, 174/107, 116

[56] References Cited

U.S. PATENT DOCUMENTS

| | | | |
|---|---|---|---|
| 3,360,409 | 12/1967 | Jachimowicz et al. | 228/130 |
| 3,629,489 | 12/1971 | Jachimowicz et al. | 174/107 |
| 3,638,306 | 2/1972 | Padowicz | 174/107 X |
| 3,711,621 | 1/1973 | Jachimowicz | 174/107 X |
| 3,785,048 | 1/1974 | Peterson | 156/54 X |
| 3,790,694 | 2/1974 | Portinari | 174/107 X |
| 4,049,904 | 9/1977 | Hori et al. | 174/107 |
| 4,109,099 | 8/1978 | Dembiak et al. | 174/107 |
| 4,218,580 | 8/1980 | Pound et al. | 174/107 |
| 4,221,926 | 9/1980 | Schneider | 174/107 |
| 4,518,034 | 5/1985 | Vokey | 174/102 D X |

*Primary Examiner*—A. T. Grimley
*Assistant Examiner*—Morris H. Nimmo
*Attorney, Agent, or Firm*—Fleit, Jacobson, Cohn & Price

[57] ABSTRACT

A cable having a composite shield and armour sheath design is disclosed. The cable comprises a cable core, a sheath of corrugated laminated tape surrounding the cable core and formed by bonding a plastic coated aluminum tape to a wider steel tape with one edge of the aluminum tape registering with one edge of the steel tape, and an outer jacket of polyethylene overlying the sheath of corrugated laminated tape. The uncovered portion of the steel tape overlaps the registering edges of the laminated tape, to form a uniform unwelded overlap.

5 Claims, 4 Drawing Figures

CABLE HAVING COMPOSITE SHIELD AND ARMOUR SHEATH DESIGN

This is a divisional of application Ser. No. 521,372, filed Aug. 8, 1983, now U.S. Pat. No. 4,518,034.

This invention relates to a cable having a composite shield and armour sheath design.

A typical example of a composite shield and armour sheath design is the ASP (aluminum, steel, polyethylene) sheat which is conventionally placed over multipair communication cable cores to provide electromagnetic shielding, protection from lightning, and mechanical protection of the cable core. This sheath is typically used on filled cable cores for direct burial applications where mechanical protection is necessary for installation and to prevent damage to the cable caused by gnawing rodents.

The sheath normally consists of a corrugated aluminum tape (typcially 0.008" thick available with or without a plastic coating on both sides of the tape) longitudinally formed around the cable core with a gap of approximately $\frac{1}{8}''-\frac{1}{4}''$ remaining between the tape edges. To provide the necessary mechanical protection a corrugated steel tape (typically 0.006" thick available with or without a plastic coating on both sides) is formed over the corrugated aluminum tape and applied with an overlap. A polyethylene jacket is extruded overall. Voids that exist under the aluminum, between the aluminum and steel tape, and between the steel tape and the polyethylene jacket are filled with suitable compounds to prevent the migration of water along the cable and prevent corrosion of aluminum and steel tapes if uncoated tapes are used.

Sheath designs which utilize a plastic coated aluminum tape and uncoated steel are sometimes referred to as a CASP (coated aluminum steel polyethylene) sheath while cables with both a coated aluminum and coated steel tape are sometimes referred to as a CACSP (coated aluminum coated steel polyethylene) sheath.

A typical manufacturing line for the manufacture of the ASP, CASP or CACSP sheath involves paying off the individual aluminum and steel tapes, corrugating each tape individually and forming both tapes around the cable core with a tape forming device. The typical manufacturing line requires a payoff, tape splicing station, a device to accumulate tape while splicing on a new length of tape, and a device for corrugating the tapes for each tape (aluminum and steel). Also required is equipment to apply a flooding compound over the cable core, between the corrugated tapes, and equipment to apply a flooding compound over the formed corrugated tapes.

The above manufacturing line has several disadvantages in processing and design:

(a) It requires duplicate pieces of equipment for processing the aluminum and steel tapes, that is two tape splicing stations, two tape accumulators and two corrugators.

(b) The corrugations of the aluminum and steel tapes do not always align themselves (it is difficult to maintain "registration") resulting in a cable of larger size. In addition, a possible water path may be formed between the two tapes.

It is therefore the object of the present invention to provide a new cable of the ASP, CASP or CACSP sheath type wherein the aluminum and steel tapes are bonded together and the laminated tape is processed as a single tape. This idea has been disclosed in U.S. Pat. No. 3,360,409 issued Dec. 26, 1967. However, the cable disclosed in the above patent suffers from a major drawback: the edges of the laminated tape are welded together after having been formed around the cable core. This automatically eliminates the possibility of introducing a flooding compound between the cable core and the sheath to provide a water tight construction because the presence of the flooding compound is not compatible with welding.

The cable process, in accordance with the present invention, comprises a cable core, a sheath of corrugated laminated tape surrounding the cable core and formed by bonding across the full width thereof a plastic coated aluminum tape to a wider steel tape with one edge of the aluminum tape registering with one edge of the steel tape, and the uncovered portion of the steel tape overlapping the registering edges of the laminated tape to form a uniform overlap, and an outer jacket of polyethylene overlying the sheath of corrugated laminated tape.

In manufacturing a first embodiment of the invention, the tape is pre-laminated, that is the steel and plastic coated aluminum tapes are bonded together in an off-line operation.

In manufacturing a second embodiment of the invention, the aluminum and steel tapes are laminated in line with the sheathing operation.

When using a pre-laminated tape, individual lengths of laminated tape are preferaby joined together and fed to an accumulator so as to allow the sheathing operation to continue while a new roll of laminated tape is loaded and joined to the existing tape of form a continuous tape. Similarly, when the aluminum and steel tapes are laminated in line with the sheathing operation, separate individual lengths of aluminum and steel tapes are joined together and fed to respective accumulators so as to allow a continuous sheathing operation while new rolls of aluminum and steel tapes are loaded and jointed to the respective continuous tapes.

Simple overlapping of the corrugated laminated tape during forming of the tape around the cable core allows complete filling of the inside corrugations of the tape once the tape is formed around the cable core so as to provide a water tight construction.

The invention will now be disclosed, by way of example, with reference to the accompanying drawings in which.

Figure 1:
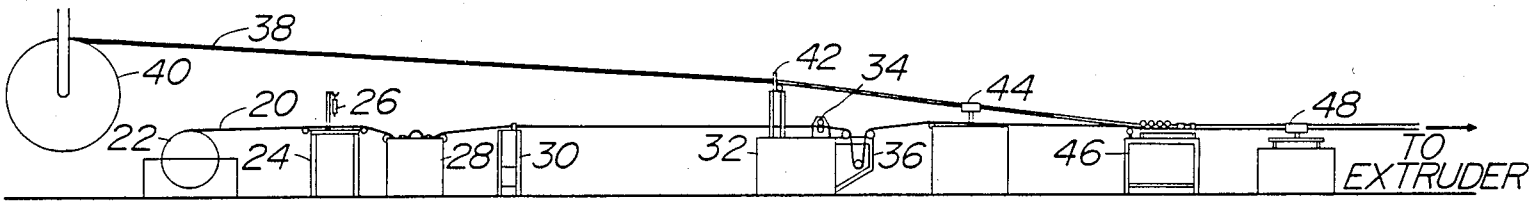
FIG. 1 is a schematic diagram illustrating the manufacture of a cable having a composite shield and armour sheath design with a pre-laminated aluminum and steel tape.

The process for manufacture of a cable having a shield and armour sheath design using a pre-laminated aluminum-steel tape is shown in FIG. 1. In this process, the steel and plastic coated aluminum tapes are bonded together in an off line operation. In the sheating process the laminated tape is corrugated and formed around a cable core with an overlap. A polyethylene jacket is applied overall.

Figure 2A:
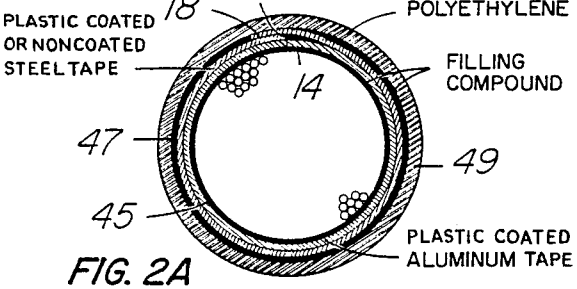
FIG. 2A is a cross-sectional view of a cable having a composite shield and armour sheath design.
Figure 2:
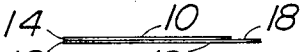
FIG. 2 is a cross section view of the laminated tape.

As shown in FIG. 2, a plastic coated aluminum tape 10 is bonded to a wider steel tape 12 with one edge 14 of the aluminum tape registering with one edge 16 of the steel tape. The uncovered portion 18 of the steel tape extends out by a predetermined amount so as to insure a uniform predetermined overlap of the tape when the tape is formed around the cable as it will be disclosed later. The plastic coated aluminum tape is preferably pressure bonded to the steel tape although other suitable bonding techniques are also envisaged.

In the assembly line shown in FIG. 1, a pre-laminated aluminum and steel tape 20, such as shown in FIG. 2, is payed off from a roll 22 and passes over a splice table 24 where individual lengths of laminated tape are joined together by means of spot welder 26.

The continuous laminated tape is then passed through an accumulator 28. This device allows an excess of tape to be dereeled off the pay off roll and stored in the accumulator. The sheathing process can thus continue while a new roll of laminated tape is loaded and spliced to the existing tape.

The laminated tape then passes through a device 30 which deposits a thin layer of oil on the tape to reduce the friction of the subsequent tape forming operation.

The laminated tape then passes through a corrugator 32 equiped with two inter-meshing rollers 34 which corrugate the tape into a sinusoidal like pattern. Before leaving the corrugator, the tape is passed through a bath 36 containing a cleaning solution to remove the oil from the tape.

The cable core 38 to be sheathed is paid off from a reel 40 and is guided over the corrugator by guiding device 42 and then passes through a device 44 which deposits a thin layer of filling compound 45 (see FIG. 2A) over the cable core. This filling compound will completely fill the corrugations inside the tape once the corrugated laminated tape is formed around the cable core.

The cable core and the corrugated tape are then passed through a conventional device 46 which guides the cable core while forming the corrugated laminated tape around the core. In the final stage of such tape forming operation, the edge 18 (FIG. 2A) of the steel tape is forced into overlapping relationship with the registering edges 14 and 16 of the laminated aluminum-steel tape.

The sheathed cable core is then passed through a device 48 which applies a flooding compound 47 (FIG. 2A) over the tape. This flooding compound prevents the steel from corroding. The flooding compound may be omitted if a plastic coated steel tape is used. The cable core is then fed to an extruder for applying an outer jacket 49 (FIG. 2A) of polyethylene thereto.

Figure 3:
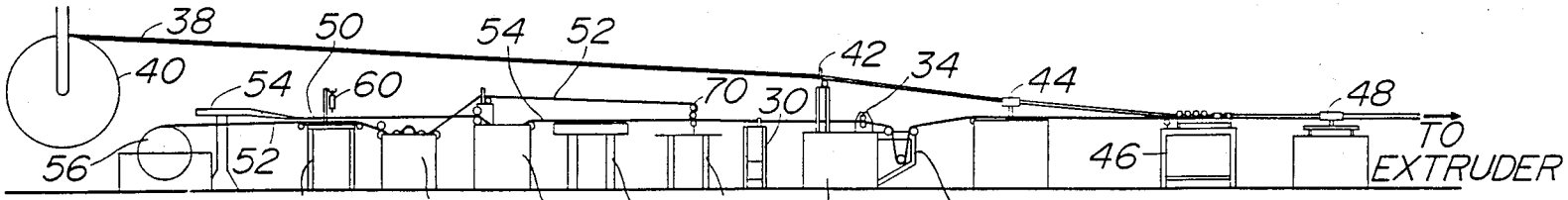
FIG. 3 is a diagram illustrating the manufacture of a cable having a shield and armour sheath design using a laminated tape formed in line with the sheathing operation.

The process for the manufacture of a cable having a shield and armour sheath design using a laminated tape formed in line with the sheathing operation is shown in FIG. 3. In this process, the individual steel and plastic coated tapes are bonded together, corrugated and formed around the cable core. A polyethylene jacket is applied overall.

In detail, individual lengths of steel tape 50 and individual lengths of plastic coated aluminum tape 52 are payed off from their respective rolls 54 and 56. Both tapes pass over a splicing table 58 where the individual lengths of each tape are joined together by means of a spot welder 60.

The aluminum tape then passes through accumulator 62 while the steel taepe by-passes accumulator 62 and enters an accumulator 64. The two accumulators allow an excess of tape to be dereeled off the payoff rolls and stored in the accumulators. The sheathing process may thus continue while the rolls of aluminum and steel tape are loaded and joined to their respective tapes.

When exiting the accumulators, the aluminum tape 52 passes above the steel tape 54. The steel tape passes over a radiant heat applicator 66 which raises the temperature of the steel tape.

The aluminum tape comes into contact with the heated steel tape in a device 68 consisting of three rollers 70 vertically in line which guide the aluminum tape above the steel tape and bring the aluminum tape in contact with the steel tape between the bottom two rollers. The combination of the heat of the steel tape and pressure exerted on the steel and coated aluminum tapes by the rollers cause the plastic coating on the aluminum tape to adhere to the steel tape. The two tapes become effectively laminated in a single tape. The laminated tape can then process through the manufacturing operation as a single tape. In the bonding operation, one edge of the aluminum tape is guided such as to register with one edge of the wider steel tape as shown in FIG. 2 of the drawings. The uncovered portion of the steel tape provides the overlap during forming of the tape around the cable core.

The laminated tape passes through lubricating device 30, corrugator 32 including rollers 34, and cleaning bath 36. These elements correspond to the elements designated by the same reference characters in the embodiment of FIG. 1 and are used for the same purpose. Similarly, the cable core 38 is paid off from reel 40, guided over guiding device 42 and passes through compound filler 44, which correspond to the elements designated by the same reference characters in FIG. 1 of the drawings.

Device 46 brings together the cable core and the laminated tape in the same manner as the corresponding element in FIG. 1. This device guides the cable core through rollers and dies while also deflecting and forming the tape around the cable core with an overlap.

A layer of flooding compound is applied to the outside portion of the sheath to prevent corrosion of the steel by device 48 which corresponds to the same element in FIG. 1. This flooding compound applicator may be omitted if plastic coated steel is used. The sheathed cable is then fed to an extruder for applying an outer jacket of polyethylene over the cable.

Although the sheathing process has been disclosed with reference to preferred embodiment, it is to be understood that other alternatives are also envisaged and that the invention is to be limited by the scope of the claims only.

I claim:

1. An electric cable having a composite shield and armour sheath design, said cable comprising:

a cable core;

a sheath of corrugated laminated tape surrounding said cable core and formed by bonding a plastic coated aluminum tape across the full width thereof to a wider steel tape with one edge of the aluminum tape registering with one edge of the steel tape and the other edge of the aluminum tape spaced inwardly of the other edge of the steel tape to define an uncovered portion of the laminated tape, said corrugated laminated tape being formed around the cable core with the uncovered portion of the laminated tape overlapping the registered edges of the laminated tape so as to provide a uniform welded overlap, and an outer jacket of polyethylene overlying said sheath.

2. An electric cable as defined in claim 1 wherein a flooding compound is provided between the cable core and the laminated tape to provide a watertight construction and to prevent corrosion of the steel.

3. An electric cable as defined in claim 1 wherein the steel tape is plastic coated.

4. An electric cable as defined in claim 1 wwherein a thin layer of a filling compound is provided over the laminated tape to substantially fill the corrugations of the laminated tape formed around said core.

5. An electric cable as defined in claim 2 wherein a thin layer of a filling compound is provided over the laminated tape to substantially fill the corrugations of the laminated tape formed around said core.

* * * * *